US011633031B2

(12) United States Patent
Lin

(10) Patent No.: US 11,633,031 B2
(45) Date of Patent: Apr. 25, 2023

(54) COSMETIC CONTAINER

(71) Applicant: LIBO COSMETICS CO., LTD., Taichung (TW)

(72) Inventor: Hsiao-Yun Lin, Taichung (TW)

(73) Assignee: LIBO COSMETICS CO., LTD., Taichung (TW)

( * ) Notice: Subject to any disclaimer, the term of this patent is extended or adjusted under 35 U.S.C. 154(b) by 353 days.

(21) Appl. No.: 16/935,184

(22) Filed: Jul. 21, 2020

(65) Prior Publication Data

US 2022/0022626 A1 Jan. 27, 2022

(51) Int. Cl.
*A45D 40/02* (2006.01)
*A45D 40/00* (2006.01)

(52) U.S. Cl.
CPC ..... *A45D 40/02* (2013.01); *A45D 40/023* (2013.01); *A45D 2040/0025* (2013.01)

(58) Field of Classification Search
CPC ..... A45D 40/02; A45D 40/023
See application file for complete search history.

(56) References Cited

U.S. PATENT DOCUMENTS 1,695,625 A * 12/1928 Wild ..... A45D 40/06 401/74
2,629,488 A * 2/1953 See ..... A45D 40/06 401/78
3,586,452 A * 6/1971 Mason ..... A45D 40/06 401/78
6,244,770 B1 * 6/2001 Holloway ..... A45D 40/06 401/78

* cited by examiner

*Primary Examiner* — Jennifer C Chiang
(74) *Attorney, Agent, or Firm* — Bruce Stone LLP; Joseph A. Bruce

(57) ABSTRACT

A cosmetic container includes a cylinder, a lining and an elevator. The cylinder is made of metal and includes a slot. The lining is made of metal, includes a helical groove, and wraps the cylinder so that the helical groove intersects the slot. The elevator is made of metal, includes a boss, and is inserted in the cylinder so that the boss is movable in and along the slot and the helical groove to elevate the elevator relative to the cylinder.

8 Claims, 9 Drawing Sheets

COSMETIC CONTAINER

BACKGROUND OF INVENTION

1. Field of Invention

The present invention relates to cosmetics and, more particularly, to a cosmetic container made of light metal to facilitate recycling.

2. Related Prior Art

Typically, a lip stick is contained in a container that includes a shell wrapping a lining. The shell is made of metal and the lining is made of resin.

The lip stick includes wax, oil and food coloring. The color and smell of the lip stick inevitably change after some time of use. The lip stick is often disposed of as well as the container in such a case.

In fact, the resin used to make the lining typically includes polyethylene terephthalate ("PET" or "PETE") that can be recycled as well as the metal used to make the shell. Yet, the lining made of the resin is expected to be recycled independent of the shell made of the metal. Hence, the lining it is expected to be removed from the shell before they are recycled separately.

However, it is difficult and hence takes a long period of time to remove the lining from the shell since the lining is tightly fitted in the shell. To save time, a user tends to leave recycling personnel with the burden of removing the lining from the shell. Thus, this causes troubles for the recycling personnel and compromises the recycling of the recyclable plastics.

The present invention is therefore intended to obviate or at least alleviate the problems encountered in the prior art.

SUMMARY OF INVENTION

It is the primary objective of the present invention to provide a cosmetic container entirely made of metal to facilitate recycling thereof.

To achieve the foregoing objective, the cosmetic container includes a cylinder, a lining and an elevator. The cylinder is made of metal and includes a slot. The lining is made of metal, includes a helical groove, and wraps the cylinder so that the helical groove intersects the slot. The elevator is made of metal, includes a boss, and is inserted in the cylinder so that the boss is movable in and along the slot and the helical groove to elevate the elevator relative to the cylinder.

In another aspect, the cylinder includes a wide section, a narrow section, an annular extension formed on the narrow section, and an annular shoulder formed between the wide and narrow sections. The lining is located between the annular extension and the annular shoulder. The slot is made in the narrow section of the cylinder.

In another aspect, the cosmetic container further includes a base and a connective collar. The base and the collective collar are both made of metal. The connective collar includes an enlarged section and a reduced section. The enlarged section of the connective collar includes a portion fitted in the base. The reduced section of the connective collar tightly wraps the wide section of the cylinder.

In another aspect, the reduced section of the connective collar includes an annular flange abutted against a closed end of the base.

In another aspect, the cosmetic container further includes a cap that is made of metal and operable to cover the enlarged section of the connective collar.

In another aspect, the enlarged section of the connective collar includes protuberances in contact with an internal face of the cap.

In another aspect, the lining further includes two transverse grooves each of which is in communication with an open end of the helical groove.

In another aspect, the lining is made by rolling a metal sheet including an upper edge, a lower edge extending parallel to the upper edge, two slant edges extending parallel to each other between the upper and lower edges, and two cutouts each of which is made at a corner between a corresponding one of the upper and lower edges and a corresponding one of the slant edges. The helical groove is made between the slant edges. The cutouts become the transverse grooves.

In another aspect, the cosmetic container further includes a shell that is made of metal and tightly wraps the lining.

In another aspect, the elevator comprises tabs formed on an internal face and operable to support the elevator.

Advantageously, the elements of the cosmetic container are all made of metal. Hence, the entire cosmetic container can be recycled without having to take it apart. The recycling of the cosmetic container is easy and the use of the cosmetic container is environmentally friendly.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
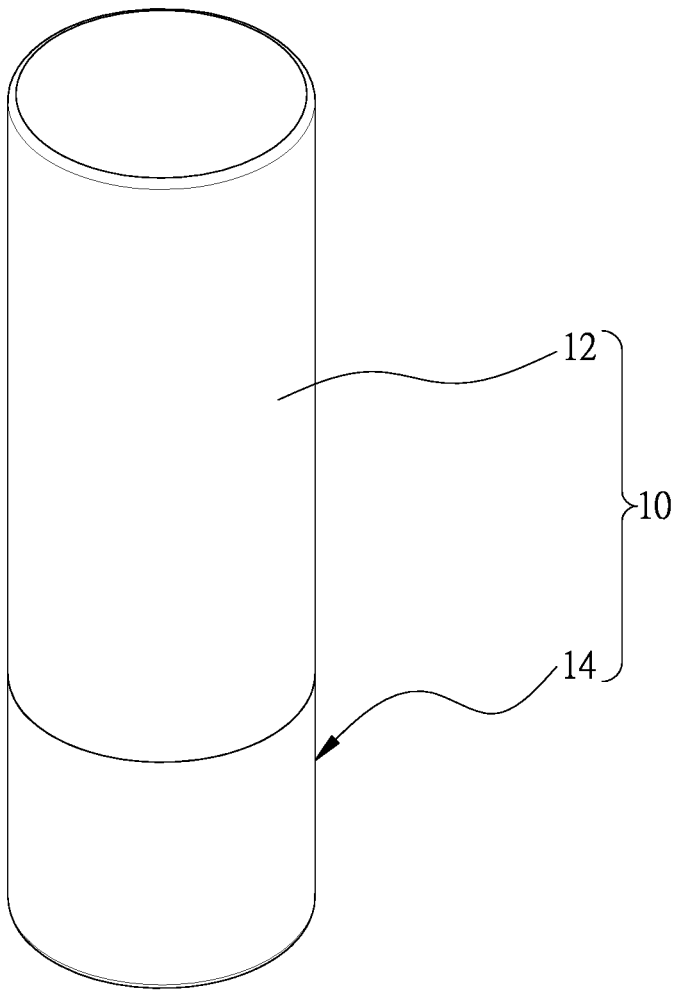
FIG. 1 is a perspective view of a cosmetic container according to the preferred embodiment of the present invention.

Referring to FIG. 1, a cosmetic container 10 includes a cap 12 and a cup 14 according to the preferred embodiment of the present invention. Both the cap 12 and the cup 14 are made of metal containing aluminum for example. The cap 12 is used to cover the cup 14. The cosmetic container 10 is circular in a cross-sectional view in the preferred embodiment. However, the cosmetic container 10 can be triangular, rectangular or polygonal in a cross-sectional view in another embodiment.

Figure 2:
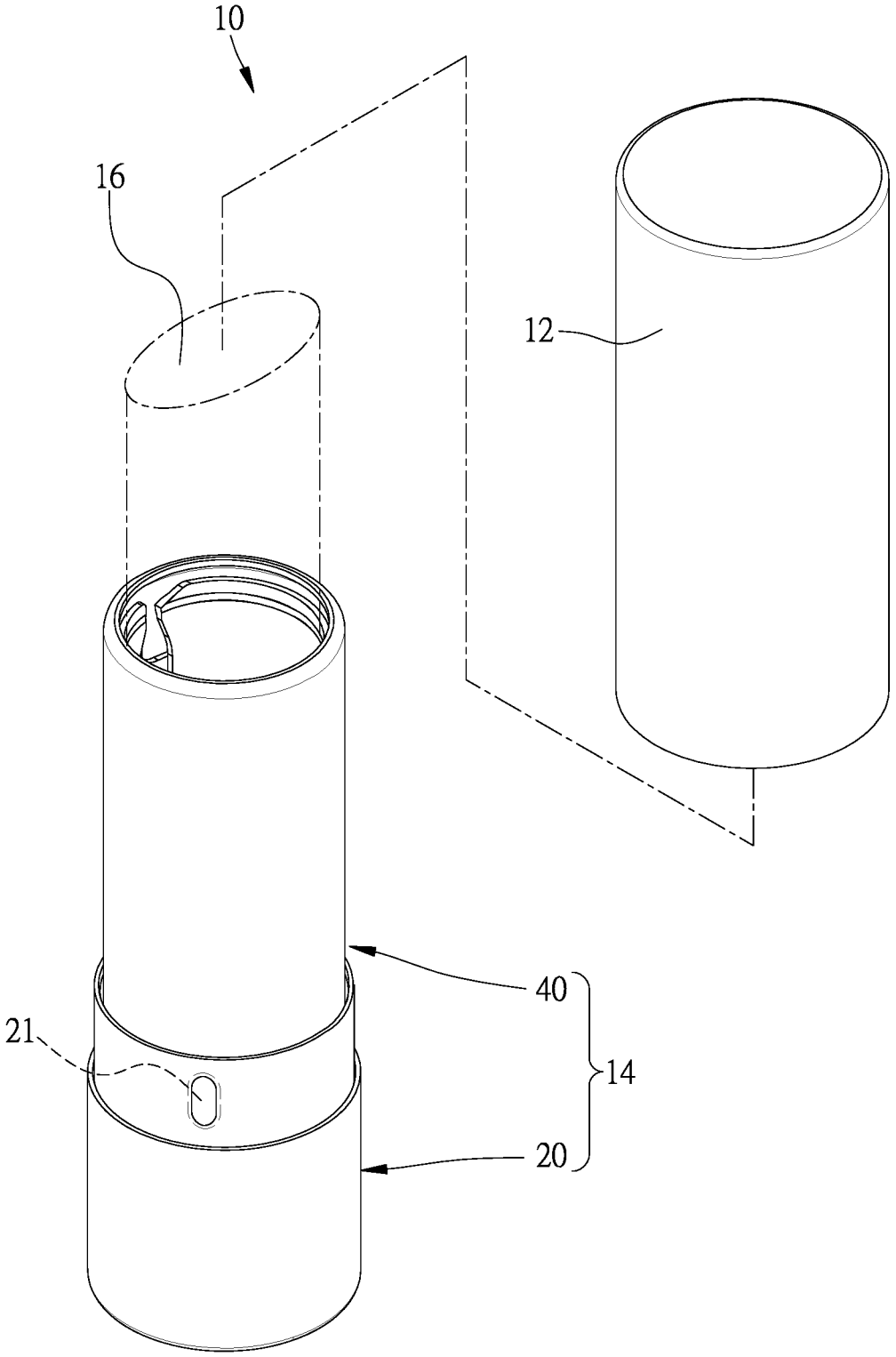
FIG. 2 is an exploded view of the cosmetic container shown in FIG. 1.

Referring to FIG. 2, the cap 12 is taken away from the cup 14 to allow the cup 14 to receive cosmetics 16 in the form of paste (such as stick foundation and blush) or a stick (such as a lip stick and a counter stick). The cup 14 includes a handle 20 and an enclosure assembly 40. The handle 20 includes several protuberances 21 formed on an external face.

Figure 5:
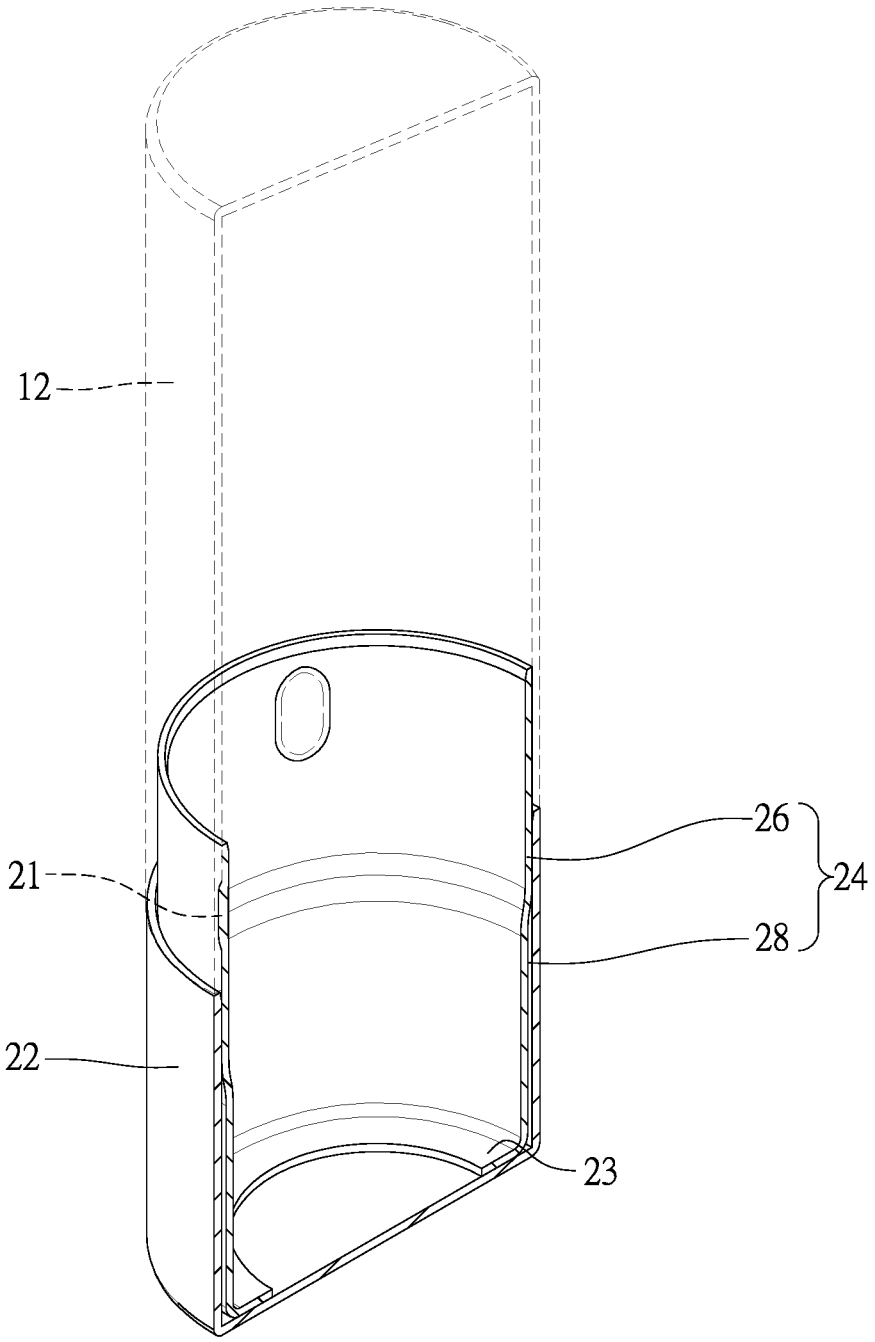
FIG. 5 is a cross-sectional view of the cosmetic container depicted in FIG. 1.

Referring to FIG. 5, the protuberances 21 of the handle 20 contact an internal face of the cap 12 when an upper section of the cup 14 is inserted in the cap 12. Thus, there can be enough friction to retain the cap 12 on the cup 14.

Figure 3:
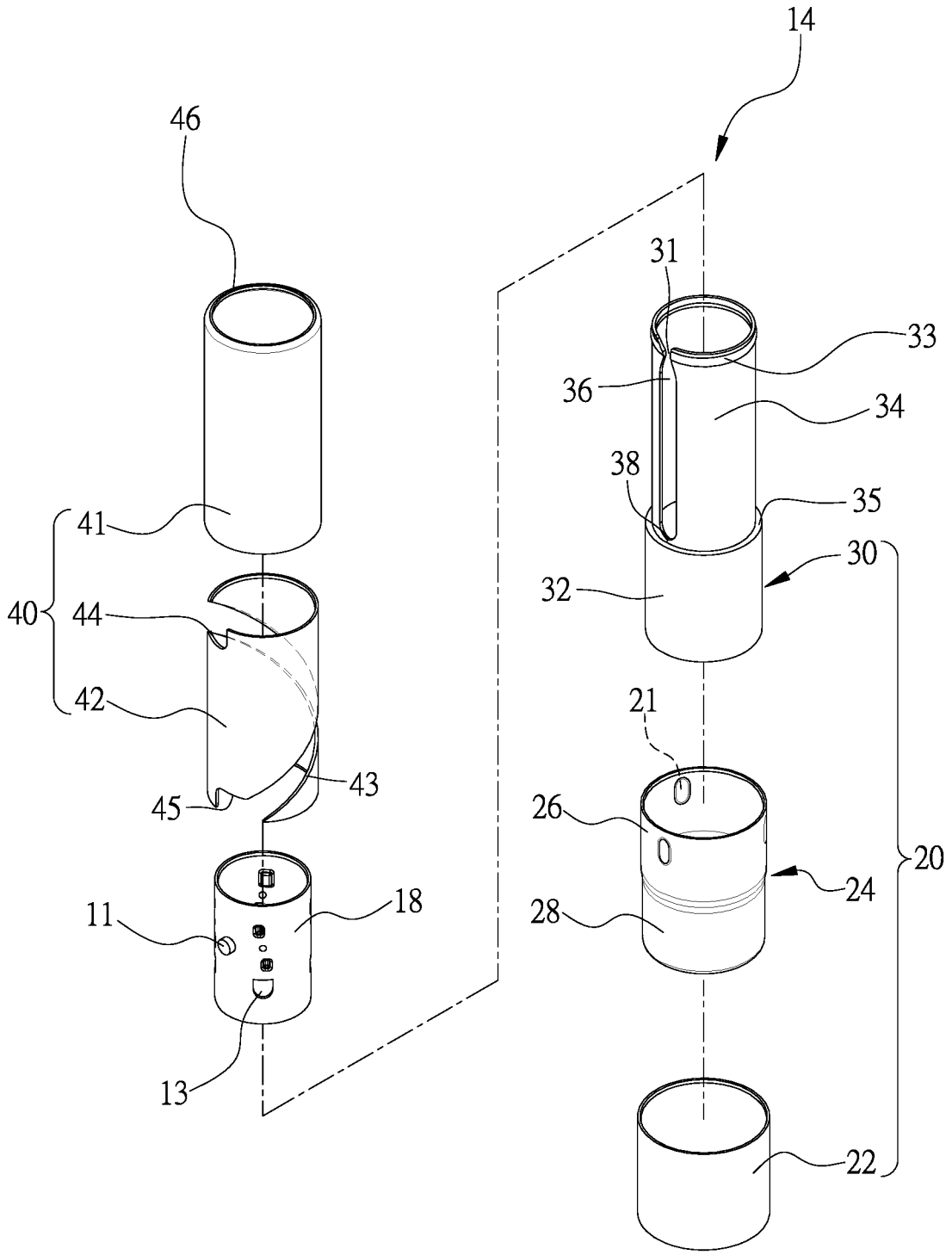
FIG. 3 is another exploded view of the cosmetic container depicted in FIG. 1.

Referring to FIG. 3, the cup 14 includes an elevator 18, a handle 20 and an enclosure assembly 40. The elevator 18 includes a section connected to the handle 20 and another section connected to the enclosure assembly 40.

The handle 20 includes a base 22, a connective collar 24 and a cylinder 30. The base 22, the connective collar 24 and the cylinder 30 are all made of metal that includes aluminum for example. The base 22 is a hollow element. The connective collar 24 includes an enlarged section 26, a reduced section 28, and an annular flange 23 at a free end of the reduced section 28. A diameter of the enlarged section 26 is larger than that of the reduced section 28. The cylinder 30 includes a wide section 32 and a narrow section 34. A diameter of the wide section 32 is larger than that of the narrow section 34, thereby forming an annular shoulder 35 between the wide section 32 and the narrow section 34. An annular extension 33 is formed at a free end of the narrow section 34. The narrow section 34 includes a longitudinal slot 36. The slot 36 includes an open end 31 at the free end of the narrow section 34 and a closed end 38 next to the annular shoulder 35. The annular extension 33 is cut by the open end 31.

Figure 4:
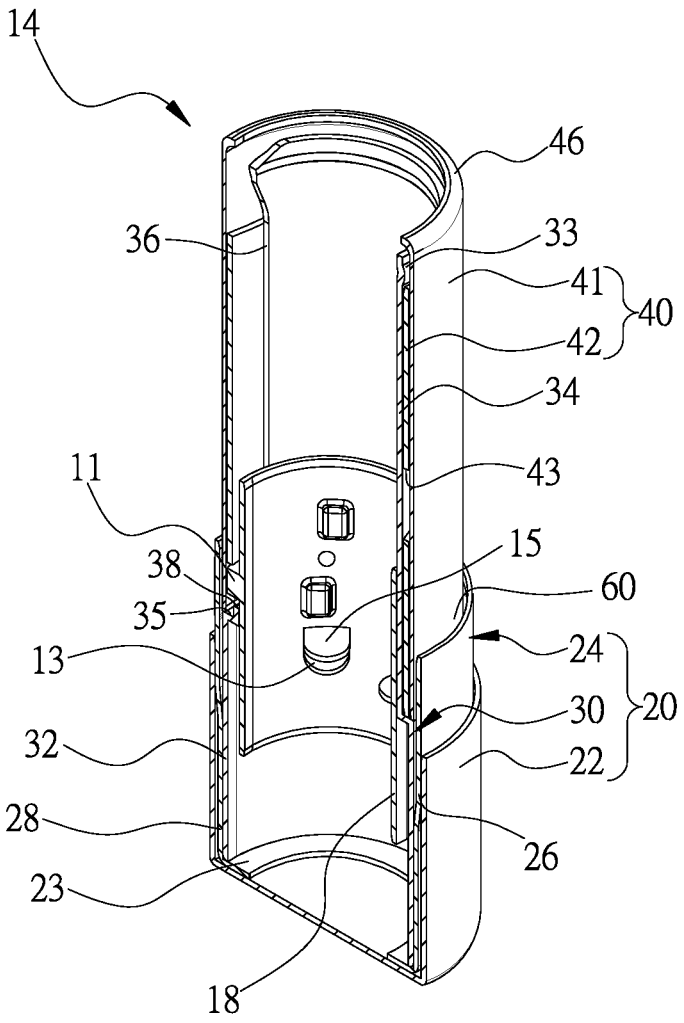
FIG. 4 is a cut-away view of the cosmetic container shown in FIG. 1 without a cap.

Referring to FIG. 4, the reduced section 28 of the connective collar 24 is inserted in the base 22. The enlarged section 26 includes a lower portion fitted in the base 22 and an upper portion located out of the base 22. The annular flange 23 abuts a closed end of the base 22. The base 22 is rotatable together with the connective collar 24. The cylinder 30 is inserted in the connective collar 24 so that the wide section 32 abuts against the annular flange 23. The wide section 32 of the cylinder 30 is fitted in the reduced section 28 of the connective ring so that the cylinder 30 is rotatable together with the connective collar 24 and the base 22. There is an annular space 60 between the narrow section 34 of the cylinder 30 and the enlarged section 26 of the connective collar 24. Thickness of the annular space 60 is larger than thickness of the annular shoulder 35.

Referring to FIG. 3, the elevator 18 includes a boss 11 formed on an external face and tabs 15 extending on an internal face. Each of the tabs 15 is made by making a U-shaped slit (not numbered) in the elevator 18 and bending the portion of the elevator 18 defined by the U-shaped slit toward an axis of the elevator 18. Thus, there is an aperture 13 next to each of the tabs 15. The tabs 15 are used to abut the cosmetics 16 (FIG. 2) to keep the cosmetics 16 at a desired depth in the elevator 18.

Figure 6:
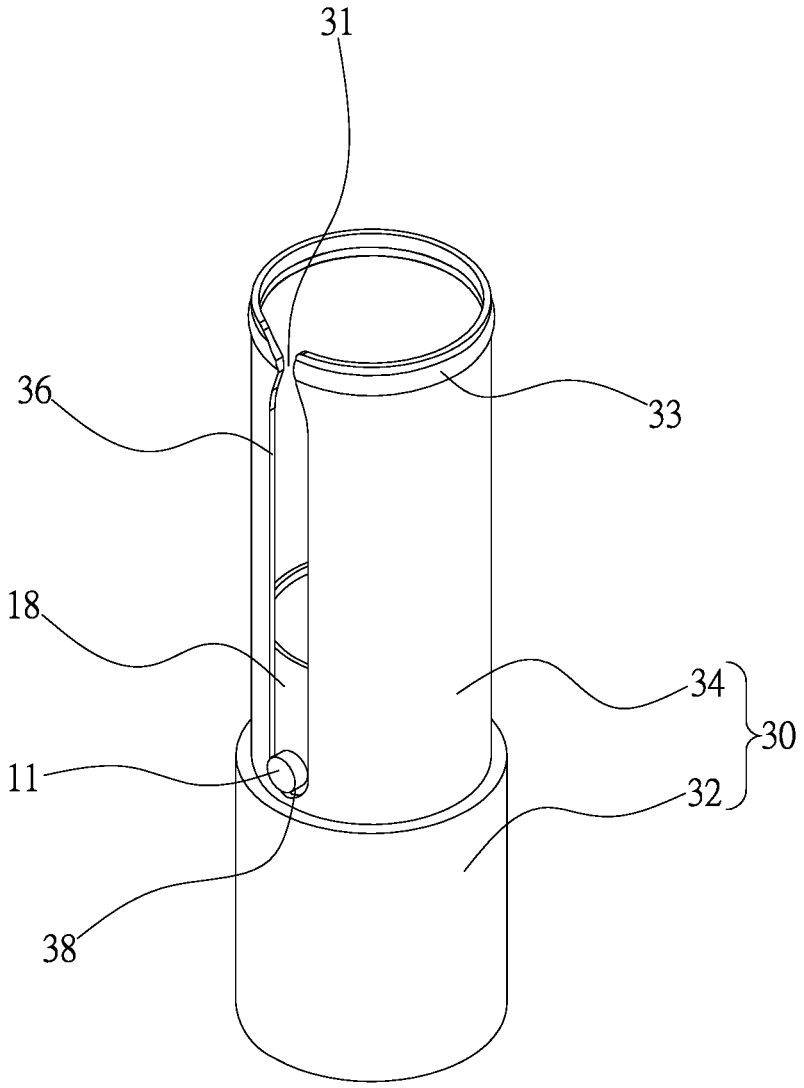
FIG. 6 is a perspective view of a cylinder and an elevator of the cosmetic container shown in FIG. 4.

Referring to FIG. 6, the elevator 18 is movably inserted in the cylinder 30. The boss 11 is movable in and along the slot 36 to allow the elevator 18 to move rectilinearly but not rotatable relative to the cylinder 30. The closed end 38 of the slot 36 is used to abut the boss 11 when the elevator 18 reaches a lower limit in the cylinder 30 (the narrow section 34).

Figure 8:
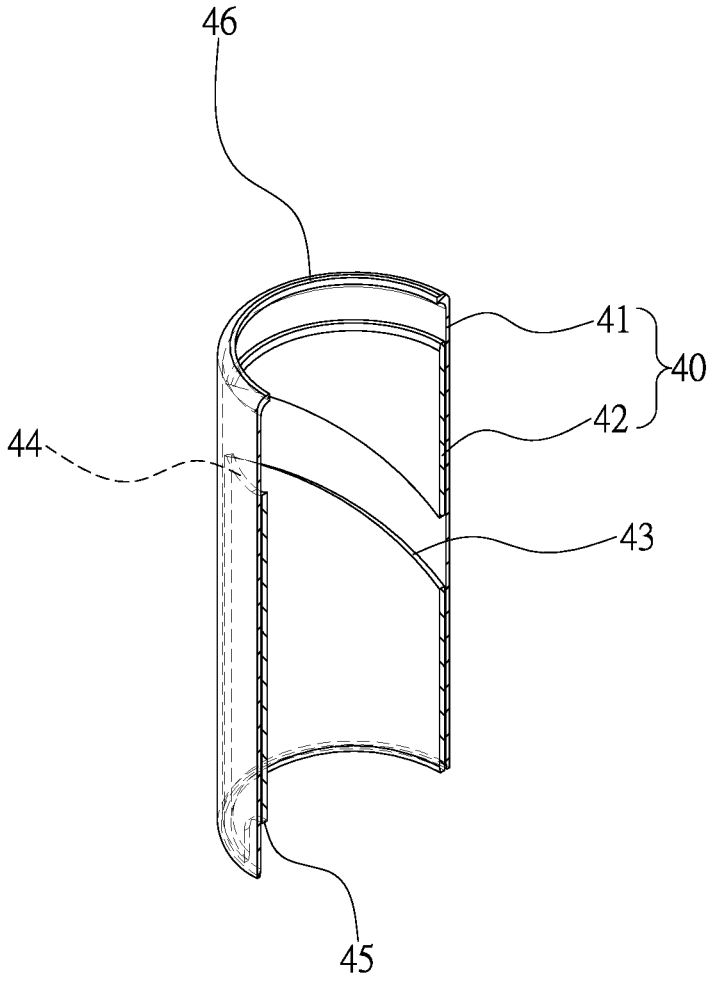
FIG. 8 is a cut-away view of an enclosure assembly of the cosmetic container shown in FIG. 2.

Referring to FIG. 8, the enclosure assembly 40 includes a shell 41 and a lining 42. The shell 41 includes an inwardly-extending edge 46 extending toward an axis of the shell 41.

Figure 9:
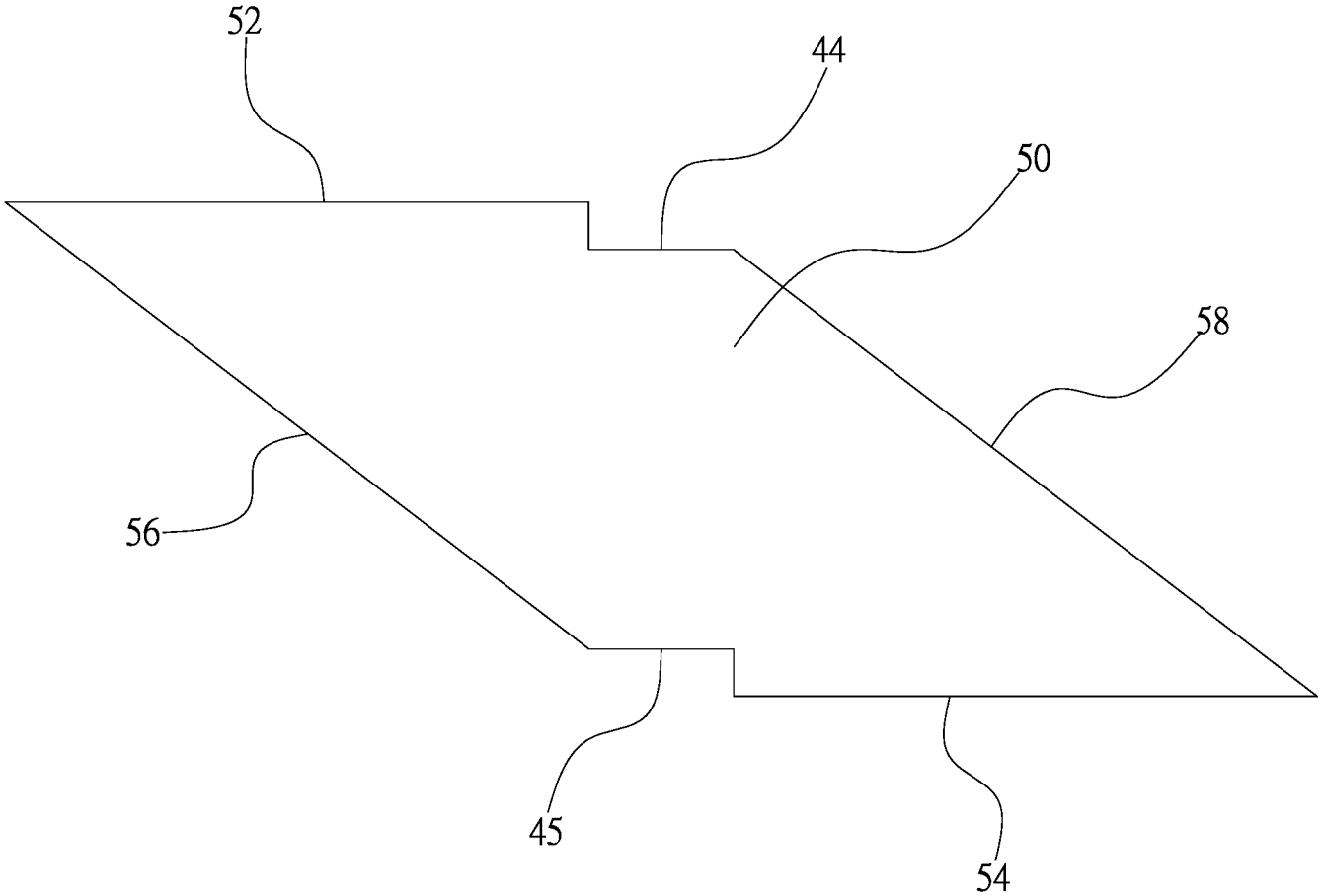
FIG. 9 is a perspective view of a metal sheet used to make the lining shown in FIG. 7.

Referring to FIG. 9, the lining 42 is made of a metal sheet 50 that contains aluminum for example. The metal sheet 50 is in the form of a parallelogram including an upper edge 52, a lower edge 54 and two slant edges 56 and 58. There is a cutout 44 at a corner of the metal sheet 50 between the upper edge 52 and the slant edge 58. Another cutout 45 is made at a corner of the metal sheet 50 between the lower edge 54 and the slant edge 56

Referring to FIGS. 8 and 9, the metal sheet 50 is rolled about an axis that extends perpendicular to two planes respectively defined by the upper and lower edges 52 and 54. Thus, there is a helical groove 43 between the slant edges 56 and 58. The cutout 44 becomes a transverse groove in communication with an open end of the helical groove 43. The cutout 45 becomes another transverse groove in communication with another open end of the helical groove 43. The lining 42 is fitted in the shell 41 so that the lining 42 is rotatable together with the shell 41.

The boss 11 extends out of the slot 36 in a radial direction of the cylinder 30. The boss 11 is movable in and along the helical groove 43.

Referring to FIG. 3, the enclosure assembly 40 wraps the narrow section 34 of the cylinder 30 and extends in the annular space 60 of the handle 20. The inwardly-extending edge 46 conceals the cylinder 30. There is a gap between the inwardly-extending edge 46 of the shell 41 and the upper edge 52 of the lining 42 to receive the annular extension 33 of the narrow section 34 to keep the lining 42 and the shell 41 in the cylinder 30. The annular extension 33 and the annular shoulder 35 render the lining 42 of the enclosure assembly 40 and the cylinder 30 of the handle 20 rotatable but not rectilinear movable relative to each other.

Figure 7:
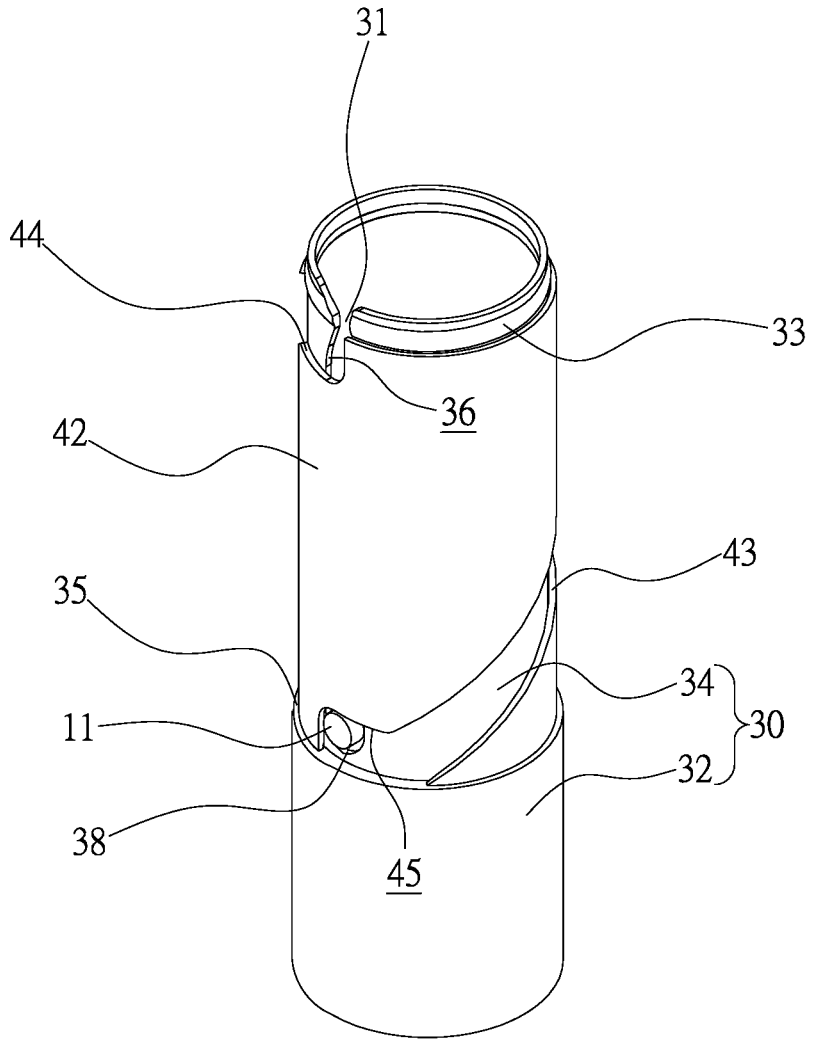
FIG. 7 is a perspective view of a lining wrapping the cylinder shown in FIG. 6.

Referring to FIG. 7, the lining 42 wraps the cylinder 30. It should be noted that the shell 41 is omitted from FIG. 7 to clearly show the relation between the handle 20 and the enclosure assembly 40.

The slot 36 allows the narrow section 34 of the cylinder 30 to shrink to allow the narrow section 34 to move throughout the lining 42 of the enclosure assembly 40. The narrow section 34 expands after the annular extension 33 moves beyond the upper edge 52 of the lining 42. The annular extension 33 is used to abut against the upper edge 52 of the lining 42. The annular shoulder 35 can abut against the lower edge 54 of the lining 42. Thus, the narrow section 34 is kept in the lining 42.

The second transverse groove 45 intersects the slot 36 to restrain the boss 11 to stop the elevator 18 (FIG. 6) from moving at a lower limit. The first transverse groove 44 intersects the slot 36 to restrain the boss 11 to keep the elevator 18 (FIG. 6) from moving at an upper limit. The boss 11 is movable in and along the slot 36 and the helical groove 43 so that the cosmetics 16 (FIG. 2) carried on the elevator 18 is rectilinearly movable relative to the cylinder 30.

All the elements of the cosmetic container are made of metal. Hence, the entire cosmetic container can be recycled without having to take it apart. The recycling of the cosmetic container is easy and the use of the cosmetic container is environmentally friendly.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cosmetic container comprising:

a cylinder that is made of metal and comprises a wide section, a narrow section, an annular extension formed on the narrow section, an annular shoulder formed between the wide and narrow sections, and a slot made in the narrow section of the cylinder;

a lining that is made of metal, comprises a helical groove, and wraps the cylinder between the annular extension and the annular shoulder so that the helical groove intersects the slot;

an elevator that is made of metal, comprises a boss, and is inserted in the cylinder so that the boss is movable in and along the slot and the helical groove to elevate the elevator relative to the cylinder;

a base made of metal; and a connective collar made of metal and formed with an enlarged section and a reduced section, wherein the enlarged section of the connective collar comprises a portion fitted in the base, and the reduced section of the connective collar tightly wraps the wide section of the cylinder.

2. The cosmetic container according to claim 1, wherein the reduced section of the connective collar comprises an annular flange abutted against a closed end of the base.

3. The cosmetic container according to claim 1, further comprising a cap that is made of metal and operable to cover the enlarged section of the connective collar.

4. The cosmetic container according to claim 3, wherein the enlarged section of the connective collar comprises protuberances in contact with an internal face of the cap.

5. The cosmetic container according to claim 1, wherein the lining further comprises two transverse grooves each of which is in communication with an open end of the helical groove.

6. The cosmetic container according to claim 1, wherein the lining is made by rolling a metal sheet comprising an upper edge, a lower edge extending parallel to the upper edge, two slant edges extending parallel to each other between the upper and lower edges, and two cutouts each of which is made at a corner between a corresponding one of the upper and lower edges and a corresponding one of the slant edges, wherein the helical groove is made between the slant edges, wherein the cutouts become the transverse grooves.

7. The cosmetic container according to claim 1, further comprising a shell that is made of metal and tightly wraps the lining.

8. The cosmetic container according to claim 1, wherein the elevator comprises tabs formed on an internal face and operable to support the elevator.

* * * * *